US005086712A

United States Patent [19]

Clark

[11] Patent Number: 5,086,712

[45] Date of Patent: Feb. 11, 1992

[54] PORTABLE COASTER KIT

[76] Inventor: Dale A. Clark, 2065 Pagan Pl., Louisville, Ky. 40218

[21] Appl. No.: 663,684

[22] Filed: Mar. 4, 1991

[51] Int. Cl.[5] ..... A47B 35/00

[52] U.S. Cl. ..... 108/50; 108/25; 135/16; 248/150; 248/346.1

[58] Field of Search ..... 248/150, 346.1, 311.2; 135/16; 108/25, 26, 50

[56] References Cited

U.S. PATENT DOCUMENTS

| | | | |
|---|---|---|---|
| 2,533,322 | 12/1950 | Kober | 135/16 |
| 3,215,095 | 11/1965 | Keppeler | 108/50 |
| 3,444,799 | 5/1969 | Covington | 135/16 X |
| 3,831,209 | 8/1974 | Clineman | 248/346.1 X |
| 4,584,946 | 4/1986 | Tucker et al. | 108/50 |
| 4,643,381 | 2/1987 | Levy | 248/346.1 X |
| 4,854,468 | 8/1989 | Dahlquist, II et al. | 248/346.1 X |

*Primary Examiner*—Ramon O. Ramirez

*Attorney, Agent, or Firm*—Leon Gilden

[57] ABSTRACT

An apparatus including a support table defined by a first and second semi-cylindrical support plate, wherein the support plates are hingedly mounted relative to one another along contiguous and coextensive hinge lines, with a plurality of hinges mounting the plates relative to one another. Each support plate includes a semi-cylindrical opening in confronting relationship relative to each other to define a cylindrical opening to receive an umbrella shaft with an umbrella canopy mounted thereon. Each support plate further includes a cylindrical opening to receive a container therethrough. A modification of the invention includes polymeric sleeves formed with a convex exterior surface to receive containers therethrough for imparting insulation to the containers. Further, modified inserts are provided, wherein the modified inserts impart buoyancy to the support plates to effect flotation of the support table on a fluid medium.

5 Claims, 4 Drawing Sheets

PORTABLE COASTER KIT

BACKGROUND OF THE INVENTION

1. Field of the Invention

The field of invention relates to coaster apparatus, and more particularly pertains to a new and improved portable coaster kit wherein the same is arranged for folding during periods of non-use and storage and opened to receive containers therewithin.

2. Description of the Prior Art

Various coaster organizations have been provided in the prior art to provide support for various container structure. Such prior art apparatus may be found in U.S. Pat. No. 4,836,488 to Ross wherein the coaster structure includes a retaining cable for securement to an associated container mounted on the coaster.

U.S. Pat. No. 4,546,946 to Jenison sets forth a coaster with a removable support plate mounted to an upper surface of the coaster.

U.S. Pat. No. 4,759,524 to Anderson sets forth a coaster provided with drainage sections mounted within the coaster structure.

U.S. Pat. No. 4,858,872 to Witt sets forth a coaster apparatus forming an opened air space between a tray and an underlying support base.

As such, it may be appreciated that there continues to be a need for a new and improved portable coaster kit as set forth by the instant invention which addresses both the problems of ease of use as well as effectiveness in construction and in this respect, the present invention substantially fulfills this need.

SUMMARY OF THE INVENTION

In view of the foregoing disadvantages inherent in the known types of coaster apparatus now present in the prior art, the present invention provides a portable coast kit wherein the same is arranged for folding during periods of non-use and storage and opened for mounting of containers therewithin, wherein the containers are formed to underlie a canopy structure. As such, the general purpose of the present invention, which will be described subsequently in greater detail, is to provide a new and improved portable coaster kit which has all the advantages of the prior art coaster apparatus and none of the disadvantages.

To attain this, the present invention provides an apparatus including a support table defined by a first and second semi-cylindrical support plate, wherein the support plates are hingedly mounted relative to one another along contiguous and coextensive hinge lines, with a plurality of hinges mounting the plates relative to one another. Each support plate includes a semi-cylindrical opening in confronting relationship relative to each other to define a cylindrical opening to receive an umbrella shaft with an umbrella canopy mounted thereon. Each support plate further includes a cylindrical opening to receive a container therethrough. A modification of the invention includes polymeric sleeves formed with a convex exterior surface to receive containers therethrough for imparting insulation to the containers. Further, modified inserts are provided, wherein the modified inserts impart buoyancy to the support plates to effect flotation of the support table on a fluid medium.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved portable coaster kit which has all the advantages of the prior art coaster apparatus and none of the disadvantages.

It is another object of the present invention to provide a new and improved portable coaster kit which may be easily and efficiently manufactured and marketed.

It is a further object of the present invention to provide a new and improved portable coaster kit which is of a durable and reliable construction.

An even further object of the present invention is to provide a new and improved portable coaster kit which is susceptible of a low cost of manufacture with regard to both materials and labor, and which accordingly is then susceptible of low prices of sale to the consuming public, thereby making such portable coaster kits economically available to the buying public.

Still yet another object of the present invention is to provide a new and improved portable coaster kit which provides in the apparatuses and methods of the prior art some of the advantages thereof, while simultaneously overcoming some of the disadvantages normally associated therewith.

Still another object of the present invention is to provide a new and improved portable coaster kit wherein the same is provided with optional inserts to impart buoyancy to the support plate to permit flotation of the coaster organization.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
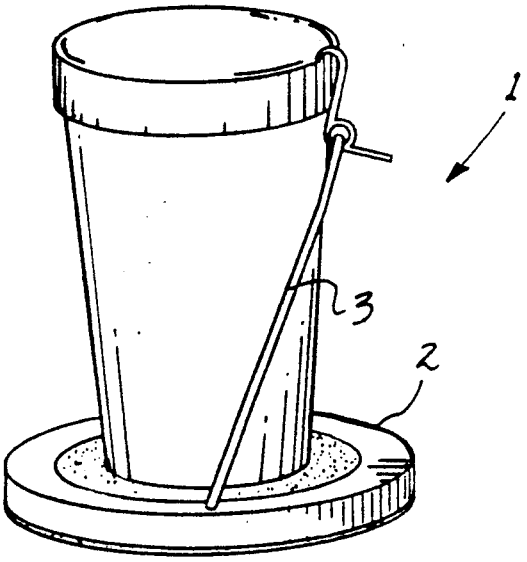
FIG. 1 is an isometric illustration of a prior art coaster apparatus.
Figure 3:
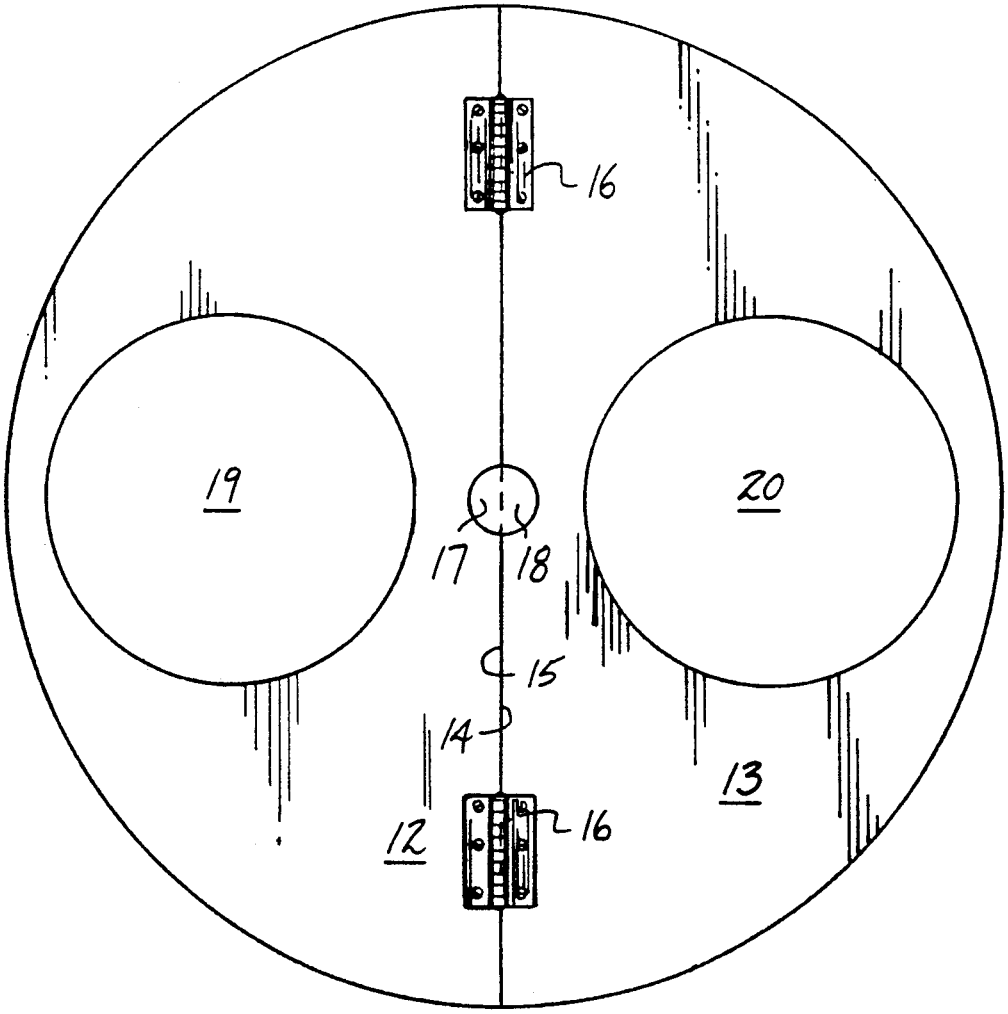
PRIOR ART FIG. 3
FIG. 3 is an orthographic view of the support table of the instant invention.
Figure 2:
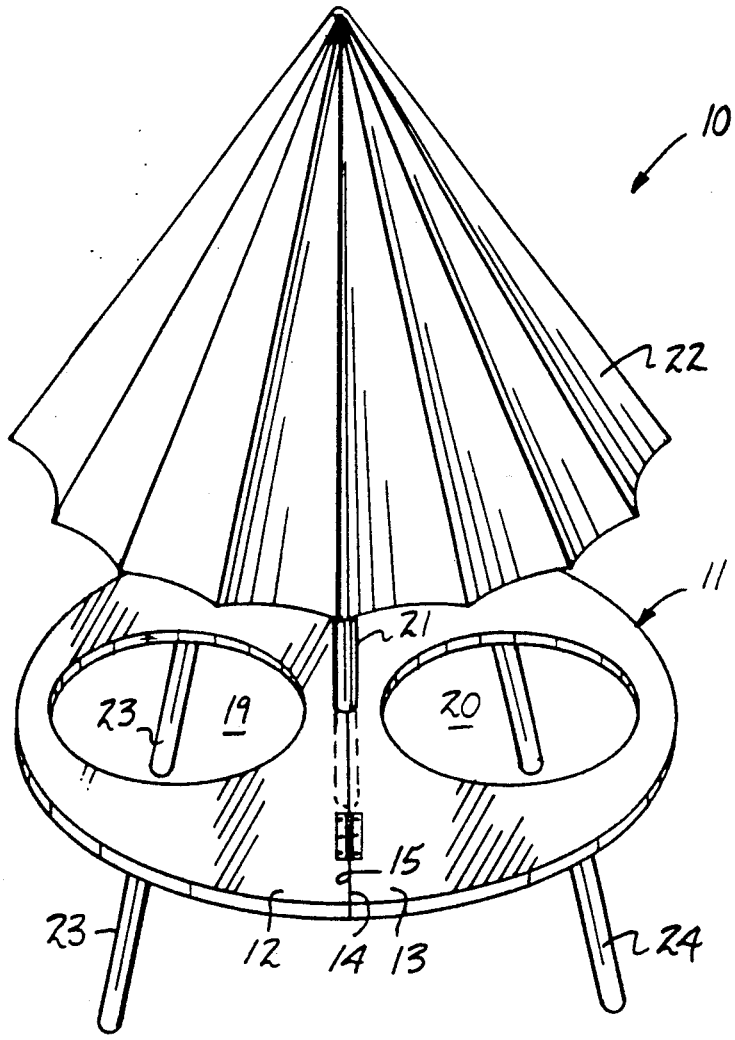
FIG. 2 is an isometric illustration of the instant invention.

With reference now to the drawings, and in particular to FIGS. 1 to 9 thereof, a new and improved portable coaster kit embodying the principles and concepts of the present invention and generally designated by the reference numeral 10 will be described.

FIG. 1 illustrates a prior art coaster organization 1, wherein a container is mounted upon a coaster plate 2, including a tether line 3 to secure the container to the coaster.

More specifically, the portable coaster kit 10 of the instant invention essentially comprises a support table 11, including a first and second semi-cylindrical support plate 12 and 13 respectively, each including a respective first and second hinge line, wherein each hinge line is coextensive and contiguous adjacent one another, with each hinge line diametrically directed through the support table 11. A plurality of hinges 16 mount the first and second semi-cylindrical support plates 12 and 13 together spanning the respective first and second hinge lines 13 and 14. Each respective first and second hinge line 13 and 14 includes a respective first and second semi-cylindrical opening 17 and 18 medially positioned in confronting relationship relative to one another to define a cylindrical opening to receive an umbrella shaft 21 therethrough mounting an umbrella canopy 22 at an upper terminal end of the umbrella shaft 21. A respective first and second cylindrical container opening 19 and 20 are directed through the respective first and second semi-cylindrical support plates 12 and 13 to receive a container "C" therethrough.

Figure 6:
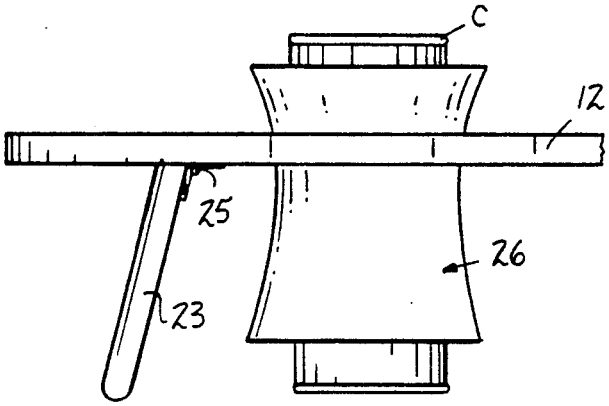
FIG. 6 is an orthographic side view of the insert of the instant invention receiving a container therethrough.

The invention contemplates the use of resilient, polymeric insulation sleeves 26 directed through each respective container opening 19 and 20. The sleeves 26 include a cylindrical sleeve opening 27 to receive a can "C" therethrough, in a manner as illustrated in FIG. 6 for example.

Figure 9:
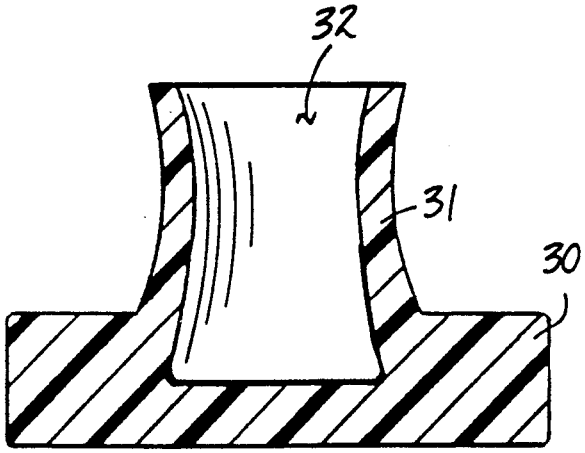
FIG. 9 is an orthographic side view, taken along the lines 9—9 of FIG. 7 in the direction indicated by the arrows.
Figure 4:
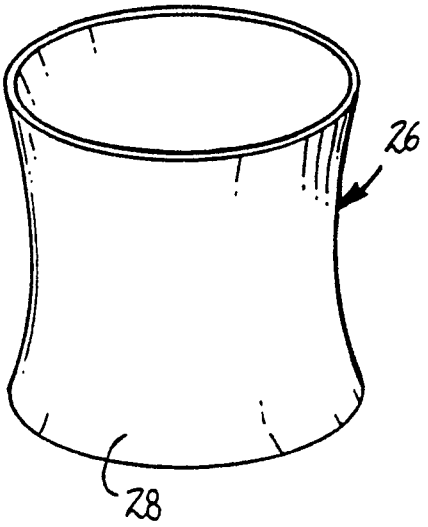
FIG. 4 is an isometric illustration of an insert utilized by the instant invention.
Figure 5:
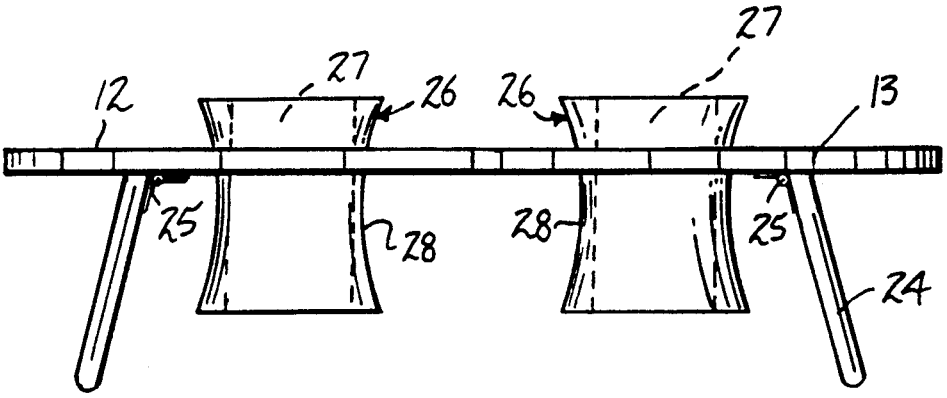
FIG. 5 is an orthographic side view of the support table mounting the inserts of FIG. 4 therewithin.
Figure 7:
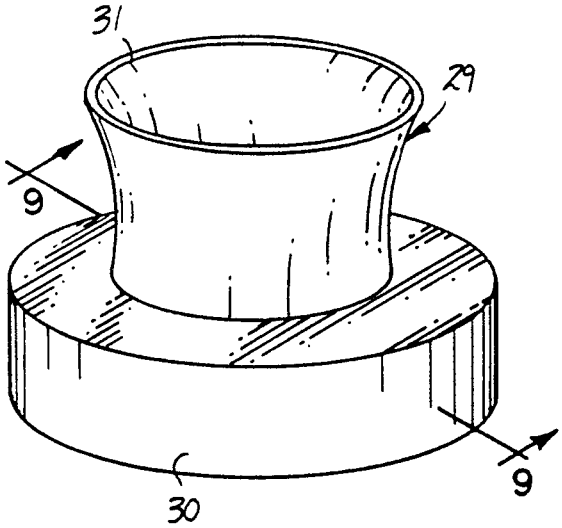
FIG. 7 is an isometric illustration of a modified coaster insert utilized by the instant invention.
Figure 8:
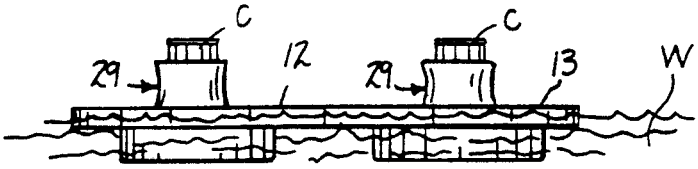
FIG. 8 is an orthographic side view of the modified inserts positioned within the support table.

FIGS. 7-9 illustrate a modified buoyant insert 29, wherein the buoyant insert 29 is mounted through each respective opening 19 and 20 to impart buoyancy to the support table 11 when container "C" is positioned within each of the buoyant inserts 29. The buoyant inserts 29 include a cylindrical base defined by a first diameter greater than the predetermined diameter of a respective container opening 19 or 20. A container receiving sleeve 31 is integrally and coaxially mounted to a top surface of the cylindrical base 30 defining a sleeve cavity 32 to receive a container "C" received therewithin. Each of the sleeves 31 is defined by a convex exterior surface as are the convex side walls 28 of the sleeves 26 to secure the resilient sleeves within each respective opening and maintain the sleeves when directed through each respective opening.

As noted, the buoyant insert 29 is arranged to also impart insulation to container "C" positioned within the sleeve cavity 32.

It should be further noted that the bottom surface of the first support plate includes a first leg pair 23, including leg hinges 25 to hingedly mount the first leg pair to the bottom surface of the first support plate, and wherein the second semi-cylindrical support plate 12 includes a second leg pair 24 incorporating leg hinges 25 to hingedly mount the second leg pair to the bottom surface of the second support plate.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A portable coaster kit comprising, combination, a support table, the support table including a first and second support plate, wherein each support plate includes a respective first and second hinge line, wherein each hinge line is coextensively and contiguously arranged in communication relative to one another, and a plurality of hinges spanning the first and second hinge line hingedly mounting the first and second support plates together, and the respective first and second hinge line including a respective first and second semi-cylindrical opening mounted medially of the respective first and second hinge line, wherein the first and second semi-cylindrical openings are in contiguous communication to define a cylindrical opening when the first and second support plates are in planar alignment relative to one another, and an umbrella shaft slidably and removably mounted within the first and second semi-cylindrical openings when the first and second support plates are in planar alignment, with the umbrella shaft including an umbrella canopy at an upper terminal end thereof, and a first leg pair hingedly mounted to a bottom surface of the first support plate, and a second leg pair hingedly mounted to a bottom surface of the second support plate.

2. An apparatus as set forth in claim 1 wherein the first support plate includes a first cylindrical opening, and the second support plate includes a second cylindrical opening, wherein the first and second cylindrical openings are arranged to receive a container therethrough.

3. An apparatus as set forth in claim 2 including an insert member positionable within each first and second cylindrical opening, each insert member including a convex side wall, wherein each insert member is formed of resilient polymeric material to impart flotation to a container directed into each insert member.

4. An apparatus as set forth in claim 3 wherein each insert member is buoyant and wherein the insert member positioned within the first cylindrical opening and the insert member inserted within the second cylindrical opening imparts buoyancy to the support table.

5. An apparatus as set forth in claim 4 wherein the insert member includes a cylindrical base, wherein the cylindrical base is defined by a first diameter and each cylindrical opening is defined by a predetermined diameter, wherein the first diameter is greater than the predetermined diameter, and a container sleeve axially and fixedly mounted to each top surface of each cylindrical base to receive a container therewithin.

* * * * *